United States Patent [19]

Satterfield

[11] 4,097,950

[45] Jul. 4, 1978

[54] DEVICE FOR SCRUBBING SURFACES

[75] Inventor: Larry S. Satterfield, Spartanburg, S.C.

[73] Assignee: Milliken Research Corporation, Spartanburg, S.C.

[21] Appl. No.: 774,883

[22] Filed: Mar. 7, 1977

[51] Int. Cl.[2] ..... A47L 11/206

[52] U.S. Cl. ..... 15/49 R; 15/385; 51/177

[58] Field of Search ..... 15/49 R, 50 R, 98, 385, 15/28, 29; 51/170 T, 170 MT, 177

[56] References Cited

U.S. PATENT DOCUMENTS

| | | | |
|---|---|---|---|
| 1,473,778 | 11/1923 | Barry | 15/49 R |
| 2,007,073 | 7/1935 | Clarke | 15/49 R |
| 2,142,933 | 1/1939 | Bickford | 15/50 R |
| 2,668,968 | 2/1954 | Dobrowolski | 15/49 R X |
| 2,759,305 | 8/1956 | Helbig | 15/49 R X |
| 3,169,262 | 2/1965 | Allen et al. | 15/49 R |

FOREIGN PATENT DOCUMENTS

| | | | |
|---|---|---|---|
| 116,274 | 4/1946 | Sweden | 15/49 R |
| 260,822 | 8/1949 | Switzerland | 15/49 R |

*Primary Examiner*—Edward L. Roberts
*Attorney, Agent, or Firm*—Robert S. Alexander; H. William Petry

[57] ABSTRACT

A device for scrubbing surfaces having pairs of freely rotatable brushes each mounted on a shaft having an offset tip portion. Each shaft is mounted on a rotating support plate and half of the shafts rotate clockwise and the other half rotate counter-clockwise. In the preferred embodiment, the scrubbers have slanted bristles which bias the rotation of each scrubber in the direction of rotation of the shaft it is mounted upon. The preferred embodiment is particularly well suited for use in cleaning carpets using the powdered cleaning composition described in U.S. Pat. No. 4,013,594.

14 Claims, 7 Drawing Figures

DEVICE FOR SCRUBBING SURFACES

The use of devices for scrubbing surfaces including carpets is well known. However, most of the prior art devices have relatively low energy inputs to the carpet and lead to streaking when used with the powdered ureaformaldehyde cleaning compositions disclosed in allowed U.S. application Ser. No. 433,707. It is thought that this streaking is due to non-uniform energy input to the carpet from the scrubber.

It is therefore an object of this invention to provide a scrubbing device which has a reduced tendency to cause streaking when used with powdered urea-formaldehyde cleaning compositions. It is another object of this invention to provide a scrubbing device which provides a relatively large but uniform energy input to the surface to be scrubbed.

The device of the present invention has eccentrically driven scrubbers which are mounted on a rotating support plate. Each scrubber is rotatably mounted on the center from which it is eccentrically driven.

Figure 3:
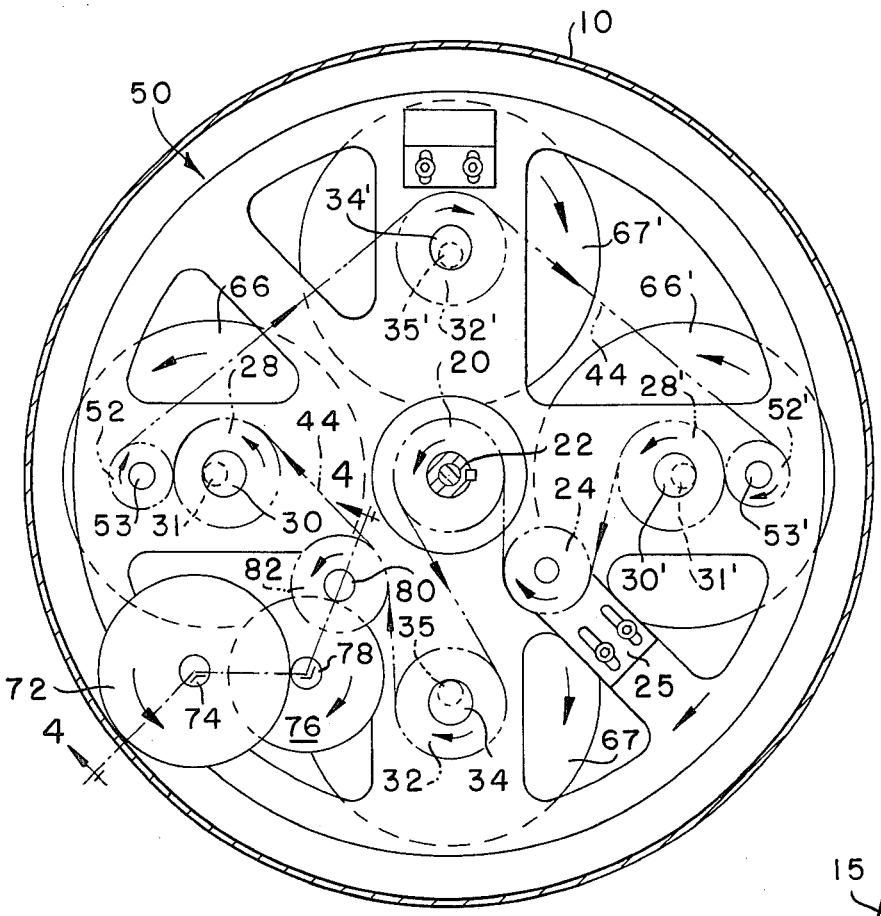
FIG. 3 is a schematic sectional view taken along line 3-3 in FIG. 2.
Figure 1:
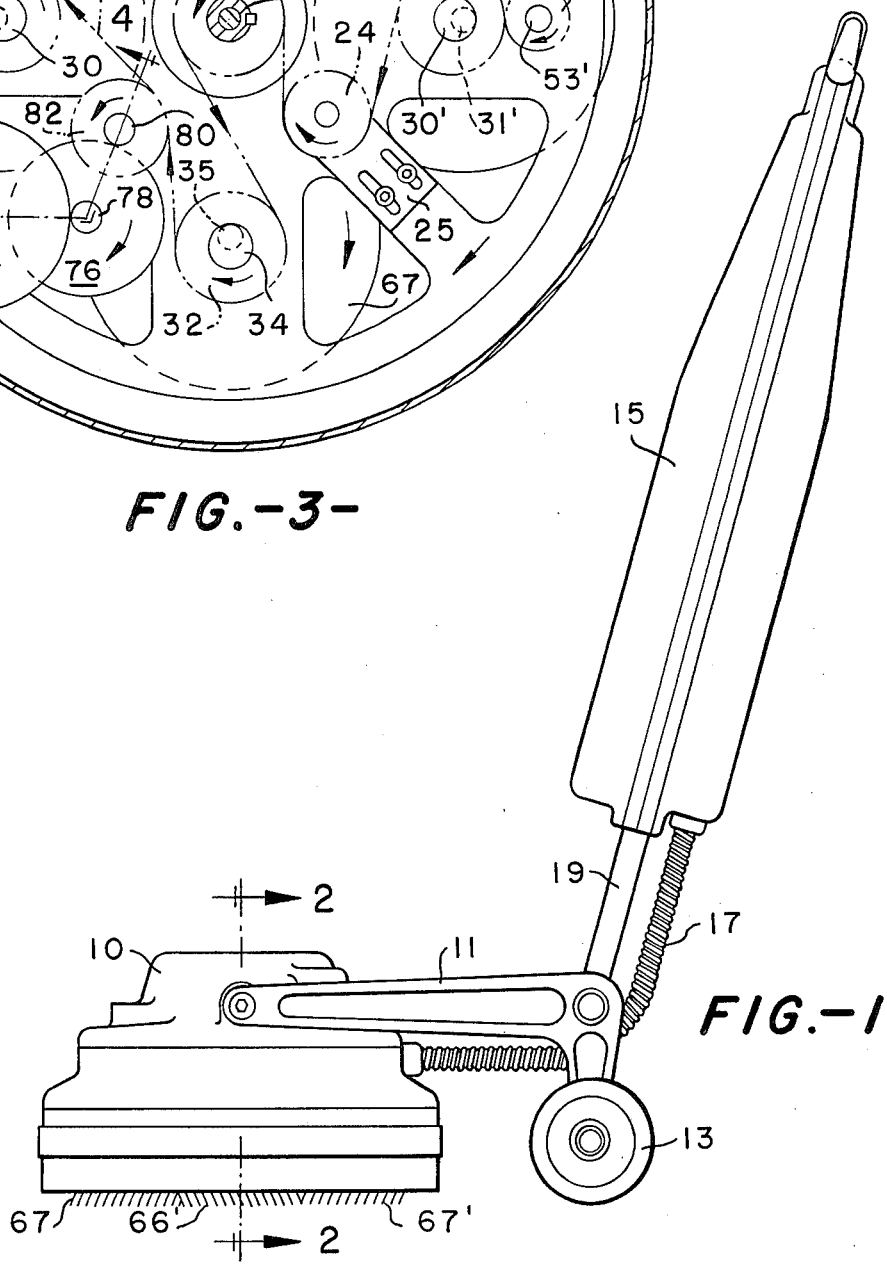
FIG. 1 is a side elevation of carpet scrubbing machine which embodies the present invention.
Figure 2:
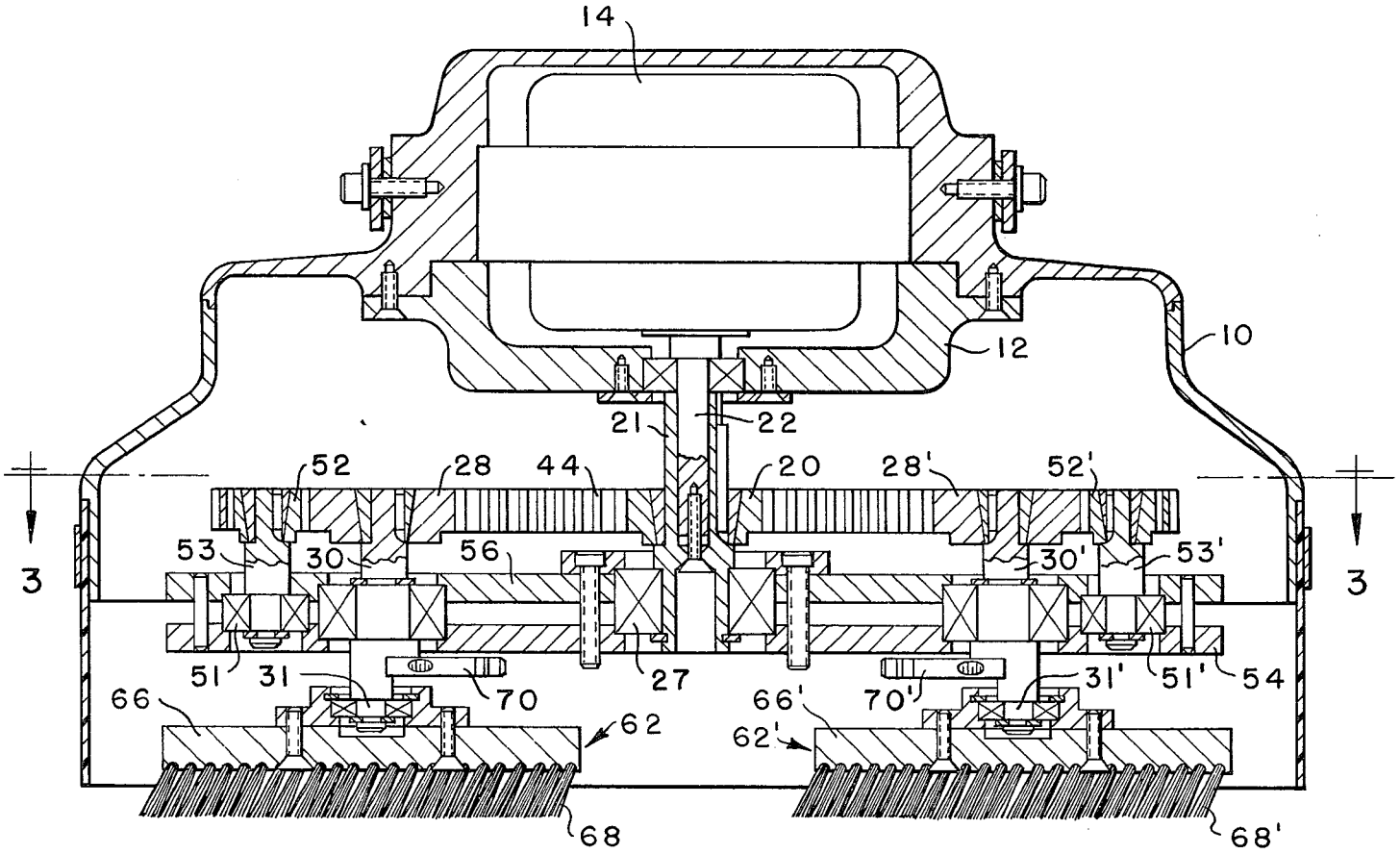
FIG. 2 is a sectional view taken along line 2-2 in FIG. 1.

Referring now in more detail to the drawings, FIG. 1 shows a scrubber embodying the present invention. Housing 10 is mounted on suspension frame 11. Wheels 13 on frame 11 provide increased stability when the device is operating and allow the device to be moved easily when not operating. Vacuum means 15 is mounted on handle 19 and is connected to the housing by flexible hose 17. In FIG. 2, 12 represents the frame upon which motor 14 is vertically mounted. Drive shaft 22 extends downward from motor 14 and is encircled by sleeve 21 which rotatably supports rotating support member 50 shown here as comprising upper rotating support plate 56 and lower rotating support plate 54. Preferably support member 50 will be mounted on sleeve 21 by a bearing such as shown at 27. Drive sheave 20 engages rubber belt 44 and is rigidly mounted on sleeve 21 which is mounted on drive shaft 22. Scrubbing elements 66, 66', 67 and 67' are rotatably mounted on the rotating support member 50 by means of shafts 30, 30', 34 and 34' which have offset tip portions 31, 31', 35 and 35' upon which the respective scrubbing elements 66, 66', 67 and 67' are mounted. Each shaft 30, 30', 34 and 34' has rigidly mounted upon it a drive sheave shown at 28, 28', 32 and 32', respectively. Drive sheaves 32 and 32' engage the inside of belt 44 and as shown in FIG. 3 are driven clockwise thereby. Idler sheaves 52 and 52' are fixed to shafts 53 and 53' which are rotatably mounted in bearings 51 and 51' mounted between support plate 54 and 56 closely adjacent to drive sheaves 28 and 28'. Idler sheaves 52 and 52' engage the inside of belt 44 but hold the exterior of belt 44 against drive sheaves 28 and 28', thereby causing drive sheaves 28 and 28' to rotate counterclockwise. To facilitate installation of belt 44, adjustable tensioning sheave 24 is rotably mounted on adjustable plate 25 which is adjustably mounted on rotating support plate 56.

Figure 4:
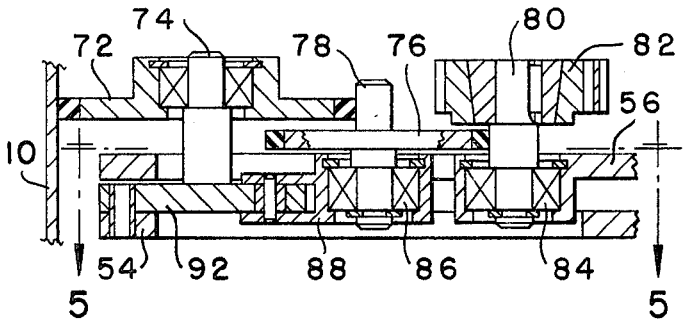
FIG. 4 is a sectional view taken along line 4-4 in FIG. 3.
Figure 5:
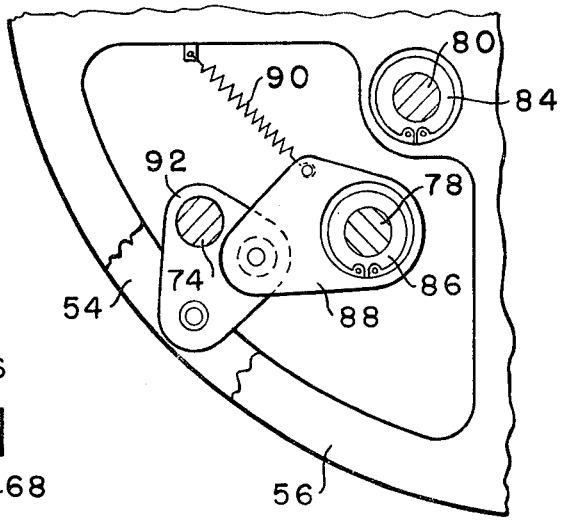
FIG. 5 is a sectional view taken along line 5-5 in FIG. 4.
Figure 6:
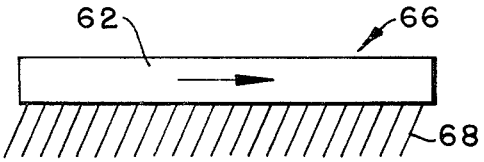
FIG. 6 is a schematic side elevation of a brush which is adapted for counterclockwise rotation as viewed from above; and, FIG. 7 is a schematic side elevation of a brush which is adapted for clockwise rotation as viewed from above.
Figure 7:
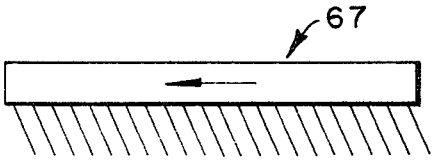

The exterior of belt 44 also engages drive sheave 82 which is rigidly mounted on shaft 80 which is mounted on rotating support plate 50 by bearing 84. The rotating support member 50 is caused to rotate relatively slowly within housing 10 through the mechanism shown in FIGS. 4 and 5. Adjustable support platform 92 is pivotably mounted on lower rotating support plate 54 and supports shaft 74 which has drive disc 72 mounted upon it. Drive disc 72 engages the substantially cylindrical portion of the interior of housing 10 and also engages intermediate shaft 78 which is mounted in bearing 86 which is fixed in intermediate support platform 88. Intermediate disc 76 is mounted upon intermediate shaft 78 and engages driven shaft 80 which is mounted in bearing 84 which is mounted on upper rotating support plate 56.

Advantageously intermediate support platform 88 is pivotably mounted upon adjustable support platform 92 and biasing means such as spring 90 are provided for holding intermediate shaft 78 in engagement with drive disc 72 while holding intermediate disc 76 in engagement with the shaft 80 which is driven by drive sheave 82. Since the diameter of drive disc 72 is much larger than the diameter of intermediate shaft 78 and since the diameter of intermediate disc 76 is much larger than the diameter of driven shaft 80, rotating support member 50 can be caused to rotate relatively slowly compared to the speed of rotation of motor 14.

Scrubber elements 66, 66', 67 and 67' are rotatably mounted on the offset tip portions 31, 31', 35 and 35' of shafts 30, 30', 34 and 34' respectively. Upon activation of motor 14, drive sheave 20 mounted on shaft 22 rotates driving belt 44. If in FIG. 3, shaft 22 is rotating counterclockwise, than shafts 30 and 30' will rotate counterclockwise while shafts 34 and 34' will rotate clockwise.

Since each scrubber element is mounted on the offset tip portion of the shaft, when shafts 30, 30', 34 and 34' are rotated, the centers of scrubber elements 66, 66', 67 and 67' will orbit around the centers of rotation of shafts 30, 30', 34 and 34'.

Preferably, each scrubber element comprises a body portion and bristles which serve as scrubbing means and may also serve as biasing means to impede rotation of the scrubbers in the direction which is opposite to the direction of rotation of the offset shaft upon which it is mounted. For example, scrubber 66 comprises body 62 and bristles 68. Advantageously, scrubber elements 66 and 66' have slanted bristles which are slanted to facilitate counterclockwise rotation, while scrubber elements 67 and 67' have bristles which are slanted to facilitate clockwise rotation.

Upon activation of motor 14, drive sheave 20 mounted on sleeve 21 is rotated which drives belt 44. If in FIG. 3, shaft 22 is rotating counterclockwise, then scrubber elements 67 and 67' will be caused to rotate clockwise while scrubber elements 66 and 66' will be caused to rotate counterclockwise. Simultaneously, rotating support member 50 will rotate clockwise.

Ideally, the scrubber of the present invention will be forcebalanced. This is accomplished by balancing each shaft and by adjusting the phase of the brushes with respect to each other. For example, in FIG. 2 counterweights 70 and 70′ are provided for each shaft 30 and 30′ and in FIG. 3 the phase of the shafts has been adjusted so that the offset tip portions 35 and 35′ of shafts 34 and 34′ will be nearest to shaft 22 when the offset tip portions 31 and 31′ of shafts 30 and 30′ are farthest away from shaft 22. Since the drive sheaves 28, 28′, 32 and 32′ are all the same size, the phase relationship is maintained as the device operates. Advantageously, belt 44 will be double-sided timing belt having evenly spaced teeth on both sides which engage corresponding teeth on the sheaves 20, 28, 28′, 32, 32′ and 82. By this means slippage can be eliminated and the proper phasing can be maintained.

I claim:

1. A device for scrubbing surfaces, comprising:
a frame;
a rotating support plate rotatably mounted on said frame;
at least two shafts rotatably mounted on said rotating support plate;
a scrubber means rotatably mounted on each shaft, each scrubber means being rotatably about an axis which is substantially parallel to but offset from the axis of rotation of said shaft;
means for rotating said rotating support plate; and
means for rotating each of said shafts;
wherein the number of said shafts rotatably mounted on said rotating support plate is even and wherein half of said shafts rotate clockwise and the other half rotate counter-clockwise.

2. The device of claim 1 further comprising biasing means for impeding the rotation of each scrubber means in the direction which is opposite to the direction of rotation of the offset shaft upon which it is mounted.

3. The device of claim 1 wherein each said scrubber means includes:
a substantially circular body portion; and
a plurality of slanted bristles fixed to said body portion, said bristles slanting so as to oppose rotation in the direction which is opposite to the direction of rotation of the offset shaft upon which it is mounted.

4. A device for scrubbing surfaces, comprising:
a frame;
a rotating support member rotatably mounted on said frame;
a first pair of offset shafts rotatably mounted on said rotating support member;
a second pair of offset shafts rotatably mounted on said rotating support member;
a scrubber means rotatably mounted on each offset shaft, each scrubber means being rotatable about an axis which is substantially parallel to but offset from the axis of rotation of said offset shaft;
means for rotating each of said first pair of offset shafts;
means for rotating each of said second pair of offset shafts in a direction which is opposite to the direction of rotation of said first pair of offset shafts; and
means for rotating said rotating support member.

5. The device of claim 4 further comprising biasing means for impeding the rotation of each scrubber means in the direction which is opposite to the direction of rotation of the offset shaft upon which it is mounted.

6. The device of claim 4 wherein each said scrubber means includes:
a substantially circular body portion; and
a plurality of slanted bristles fixed to said body portion, said bristles slanting so as to oppose rotation in the direction which is opposite to the direction of rotation of the offset shaft upon which it is mounted.

7. The device of claim 6, further comprising:
a drive shaft rotatably mounted on said frame;
a first drive sheave rigidly mounted on said drive shaft;
means mounted on said frame for rotating said drive shaft; and
a flexible drive means engaging said first drive sheave and operably connected to said means for rotating each of said first pair of offset shafts and operably connected to said means for rotating each of said second pair of offset shafts.

8. The device of claim 7 wherein said flexible drive means has two drive surfaces and wherein each means for rotating each shaft of said first pair of offset shafts comprises a forward drive sheave mounted on said offset shaft and engaging one drive surface of said flexible drive means and wherein each means for rotating each shaft of said second pair of offset shafts comprises:
a reverse drive sheave rigidly mounted on said offset shaft and engaging the other side of said flexible drive member; and
an idler sheave rotatably mounted on said rotating support member, engaging said one side of said flexible drive member, and maintaining said other side of said flexible drive member in engagement with said reverse drive sheave.

9. The device of claim 8 wherein said flexible drive means is a timing belt having evenly spaced teeth on both sides thereof and wherein each drive sheave has evenly spaced teeth the spacing of which corresponds to the spacing of the teeth on said timing belt.

10. The device of claim 9 further comprising a housing having a substantially cylindrical rim portion substantially encompassing said rotating support member and wherein said means for rotating said rotating support member comprises:
an adjustable platform pivotably mounted on said rotating support member;
a drive disc rotatably mounted on said adjustable platform and engaging said substantially cylindrical rim portion; and
drive means operably associated with said drive disc for rotating said drive disc in response to rotation of said drive shaft, and thereby said rotating support member.

11. The device of claim 10 wherein said drive means for rotating said drive disc comprises:
an intermediate platform pivotably mounted on said adjustable platform;
an intermediate shaft rotatably mounted on said intermediate platform and engaging said drive disc;
an intermediate disc mounted on said intermediate shaft;
a driven shaft rotatably mounted on said rotating support member and engaging said intermediate disc;
a drive sheave mounted on said driven shaft and engaging said two-sided timing belt; and
biasing means for urging said intermediate disc into engagement with said driven shaft and urging said intermediate shaft into engagement with said drive disc.

12. A device for scrubbing surfaces comprising:

a frame;

a rotating support member rotatably mounted on said frame;

at least one pair of shafts rotatably mounted on said rotating support member;

a scrubber means rotatably mounted on each shaft, each scrubber means being rotatable about an axis which is substantially parallel to but offset from the axis of rotation of said shaft;

means for rotating said rotating support member;

means for rotating each of said shafts so that half of said shafts rotate clockwise and the other half rotate counterclockwise; and means for biasing the rotation of each of said scrubber means so that upon operation half of said scrubber means rotate clockwise and the other half rotate counterclockwise.

13. The device of claim 12 wherein said means for biasing includes bristles on each scrubber means, the bristles on half of said scrubber means being slanted to facilitate clockwise rotation and the bristles on the other half of said scrubber means being slanted to facilitate counterclockwise rotation.

14. The device of claim 13 wherein the scrubber means which have bristles which are slanted to facilitate clockwise rotation are mounted on the shafts which rotate clockwise and the scrubber means which have bristles which are slanted to facilitate counterclockwise rotation are mounted on the shafts which rotate counterclockwise.

* * * * *

UNITED STATES PATENT OFFICE

CERTIFICATE OF CORRECTION

Patent No. 4,097,950 Dated July 4, 1978

Inventor(s) Larry S. Satterfield

It is certified that error appears in the above-identified patent and that said Letters Patent are hereby corrected as shown below:

Column 3, line 23, the word "rotatably" should read --rotatable--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*